US007859503B2

(12) United States Patent
Sasaki et al.

(10) Patent No.: US 7,859,503 B2
(45) Date of Patent: Dec. 28, 2010

(54) LIQUID CRYSTAL DISPLAY DEVICE AND METHOD OF DRIVING THE SAME

(75) Inventors: Takahiro Sasaki, Kawasaki (JP); Yuichi Inoue, Kawasaki (JP); Mikio Oshiro, Kawasaki (JP); Kenko Honda, Kawasaki (JP)

(73) Assignees: Fujitsu Limited, Kawasaki (JP); Au Optronics Corporation, Hsinchu (TW)

( * ) Notice: Subject to any disclaimer, the term of this patent is extended or adjusted under 35 U.S.C. 154(b) by 866 days.

(21) Appl. No.: 11/059,109

(22) Filed: Feb. 16, 2005

(65) Prior Publication Data

US 2006/0066544 A1 Mar. 30, 2006

(30) Foreign Application Priority Data

Sep. 28, 2004 (JP) ..... 2004-281380

(51) Int. Cl.
*G09G 3/36* (2006.01)

(52) U.S. Cl. ..... 345/94; 345/87

(58) Field of Classification Search ..... 345/87–104
See application file for complete search history.

(56) References Cited

U.S. PATENT DOCUMENTS 3,776,615 A * 12/1973 Tsukamoto et al. ..... 345/87
6,115,020 A * 9/2000 Taguchi et al. ..... 345/99
2001/0038369 A1 11/2001 Adachi et al.
2001/0040546 A1 * 11/2001 Ohmuro et al. ..... 345/87
2003/0160750 A1 * 8/2003 Ueda et al. ..... 345/87
2006/0038761 A1 * 2/2006 Shen et al. ..... 345/92

FOREIGN PATENT DOCUMENTS

| | | |
|---|---|---|
| JP | 11-242225 | 9/1999 |
| JP | 2000-231091 | 8/2000 |
| JP | 2001-117074 | 4/2001 |
| JP | 2001-343956 | 12/2001 |

* cited by examiner

*Primary Examiner*—Alexander Eisen
*Assistant Examiner*—Cory A Almeida
(74) *Attorney, Agent, or Firm*—Kratz, Quintos & Hanson, LLP

(57) ABSTRACT

In driving a liquid crystal display device having an alignment regulating structure for regulating liquid crystal, when the display state of the pixel is to be changed from a dark display to a bright display, a difference between the magnitude of a voltage Vd4 applied to the liquid crystal of the pixel at the beginning of the first frame and the magnitude of a voltage Vd3 applied to the liquid crystal of the pixel in the second frame or a subsequent frame, is set to be greater than a voltage Vod that decreases in the first frame due to an increase in the liquid crystal capacitance of the pixel.

13 Claims, 15 Drawing Sheets

LIQUID CRYSTAL DISPLAY DEVICE AND METHOD OF DRIVING THE SAME

BACKGROUND OF THE INVENTION

1. Field of the Invention

This invention relates to a liquid crystal display device and to a method of driving the same. More particularly, the invention relates to a liquid crystal display device which has an alignment regulating structure regulating the alignment of vertically aligned liquid crystal and to a method of driving the same.

2. Background of the Invention

A liquid crystal display device has a pair of substrates arranged facing each other, and a liquid crystal sealed between the two substrates. In the liquid crystal display device of the MVA (multi-domain vertical alignment) mode, the vertically aligned type liquid crystal having a negative dielectric anisotropy is regulated for the alignment due to the alignment regulating structure, such as protrusions partly formed on the substrate, slits in the electrode, or the like (see, for example, Japanese Patent No. 2947350). The liquid crystal display device of the MVA mode possesses such advantages as a high response time, a high contrast and a wide viewing angle as compared to the liquid crystal display devices of other display modes such as TN (twisted nematic) mode or IPS (in-plane switching) mode. Owing to improvements in the characteristics of the liquid crystal materials and drive system in the liquid crystal display devices of the TN mode and IPS mode in recent years, however, there has been realized a response of a speed higher than that of the conventional MVA mode. Further, if consideration is given to coping with the dynamic picture display such as in the use of TV receivers, the response characteristics of the liquid crystal display device of the conventional MVA mode are not necessarily satisfactory.

FIG. 11 illustrates an equivalent circuit of a pixel in a conventional general liquid crystal display device. Referring to FIG. 11, each pixel is provided with a thin-film transistor (TFT) as a switching element. The gate electrode of the TFT is connected to a gate bus line and is applied with a predetermined gate voltage Vg. The drain electrode of the TFT is connected to a drain bus line and is applied with a predetermined data voltage Vd. The source electrode of the TFT is connected to the electrodes on one side of a liquid crystal capacitance Clc and of a storage capacitor Cs. The electrodes on the other side of the liquid crystal capacitance Clc and the storage capacitor Cs are maintained at a common voltage Vcom.

FIG. 12(*a*) is a graph illustrating a gate voltage Vg applied to the gate bus line connected to the gate electrode of the TFT of a given pixel, FIG. 12(*b*) is a graph illustrating a data voltage Vd (absolute value) applied to the drain bus line connected to the drain electrode of the TFT in the pixel, and FIG. 12(*c*) is a graph illustrating the brightness of the pixel. The abscissas of FIGS. 12(*a*) to 12(*c*) represent the time, the ordinate of FIGS. 12(*a*) and 12(*b*) represent the voltage levels, and the ordinate of FIG. 12(*c*) represents the brightness (%).

Referring to FIG. 12(*a*), a voltage Vgon (gate pulse) is applied to the gate electrode of the TFT of the pixel at times t0, t1, t2, . . . of every frame period, and the TFT is periodically turned on. When the TFT is turned on, the data voltage Vd is applied to the pixel electrode of the pixel, and the electric charge is stored in the liquid crystal capacitance Clc and in the storage capacitor Cs. The stored electric charge is held for one frame period until the TFT is turned on next. Referring to FIG. 12(*b*), the data voltage Vd applied to the drain bus line is changing between a time t0 and a time t1 from a voltage Vd1 displaying back to a voltage Vd2 displaying white (|Vd2|>|Vd1|). That is, before the time t0, the voltage Vd1 is applied to the pixel electrode of the pixel and after the time t1, the voltage Vd2 is applied. Here, the frame period from the time t1 at which the voltage applied to the pixel electrode changes, is referred to as the first frame. In the first frame, the state of alignment of liquid crystal in the pixel changes depending upon the electric charge stored in the liquid crystal capacitance Clc, and the brightness changes as represented by a line b1 in FIG. 12(*c*).

If attention is given to a change in the brightness, it will be learned that the change in the brightness is saturated in the latter half of the first frame, and the brightness changes again in the second frame. Therefore, the response waveform of brightness changes like a step for every frame period. In the conventional liquid crystal display device, the response time is lengthened due to the occurrence of two-step (multi-step) response in which the response waveform of brightness consists of two steps (or three or more steps), making it difficult to accomplish a high-speed response. Here, when the brightness changes from 0% to 100%, the time required for the brightness to change from 10% to 90% is referred to as response time.

Described below is a cause of producing the two-step response. FIG. 13(*a*) is a graph illustrating a relationship between the voltage applied to the liquid crystal and the brightness, and FIG. 13(*b*) is a graph illustrating a relationship between the voltage applied to the liquid crystal and the liquid crystal capacitance Clc. The abscissas of FIGS. 13(*a*) and 13(*b*) represent applied voltages, the ordinate of FIG. 13(*a*) represents the level of brightness, and the ordinate of FIG. 13(*b*) represents the liquid crystal capacitance Clc. The applied voltage at a starting brightness Boff which is the black display is denoted by Voff, and the liquid crystal capacitance is denoted by Clcoff. Further, the applied voltage at a target brightness Bon which is the white display is denoted by Von. As shown in FIGS. 13(*a*) and 13(*b*), the voltage Von (arrow x1 in FIG. 13(*b*)) is applied to the liquid crystal at the beginning of the first frame. Then, the electric charge Q (=(Clcoff+Cs)× Von) is stored in the liquid crystal capacitance Clc and in the storage capacitor Cs, and is held for one frame period. When the liquid crystal responds upon the application of the voltage Von, the liquid crystal capacitance Clc increases by ΔClc in the first frame due to the dielectric anisotropy of the liquid crystal. On the other hand, the electric charge Q remains constant due to the law of retention of electric charge. Therefore, $$Q=(Clc\text{off}+\Delta Clc+Cs)\times(V\text{on}-\Delta V)$$

and the voltage applied to the liquid crystal decreases by ΔV in the first frame as represented by an arrow x2 along a curve q of an equal electric charge. Therefore, the brightness B1 that is reached in the first frame becomes lower than the target brightness Bon. Similarly, though the voltage Von is applied (arrow x3) at the beginning of the second frame, the applied voltage decreases (arrow x4) accompanying a change in the liquid crystal capacitance Clc, and the brightness B2 reached in the second frame becomes lower than the target brightness Bon. Therefore, several frames are necessary before the brightness of the pixel reaches the target brightness Bon. Due to a decrease in the applied voltage caused by an increase in the liquid crystal capacitance Clc, the change in the brightness is saturated in the frame period, i.e., a two-step response of brightness occurs.

To accomplish a high-speed response of the liquid crystal display device suppressing the two-step response of brightness, the following two methods were so far considered.

(1) To relatively decrease the effect of change in the liquid crystal capacitance Clc by increasing the storage capacitor Cs.

(2) To increase the applied voltage of the first frame by taking a change in the liquid crystal capacitance Clc into consideration (so-called over-drive system).

However, the above method (1) has a defect in that the brightness decreases since the aperture ratio of the pixels decreases with an increase in the storage capacitor Cs.

FIG. 14(*a*) is a graph illustrating a relationship between the voltage applied to the liquid crystal in the liquid crystal display device using the method (2) and the brightness, and FIG. 14(*b*) is a graph illustrating a relationship between the voltage applied to the liquid crystal and the liquid crystal capacitance Clc. According to the method (2) as shown in FIGS. 14(*a*) and 14(*b*), the voltage applied at the beginning of the first frame is increased by Vod (arrow x5 in FIG. 14(*b*)) by taking a change in the liquid crystal capacitance Clc into consideration. The electric charge Q (=(Clcoff+Cs)×(Von+Vod)) is stored in the liquid crystal capacitance Clc and in the storage capacitor Cs. Accompanying an increase in the liquid crystal capacitance Clc, the applied voltage drops by Vod in the first frame (arrow x6). Therefore, a voltage Von necessary for obtaining a target brightness Bon is applied to the liquid crystal at the end of the first frame as expressed by the following formula, $$Q=(Clc\text{off}+\Delta Clc+Cs)\times(V\text{on}+V\text{od}-V\text{od})=(Clc\text{off}+\Delta Clc+Cs)\times V\text{on}$$

FIG. 15(*a*) is a graph illustrating a gate voltage Vg applied to the gate bus line connected to the gate electrode of the TFT of a given pixel, FIG. 15(*b*) is a graph illustrating a data voltage Vd applied to the drain bus line connected to the drain electrode of the TFT of the above pixel, and FIG. 15(*c*) is a graph illustrating the brightness of the pixel. The abscissas and ordinates of FIGS. 15(*a*) to 15(*c*) are the same as the abscissas and the ordinates of FIGS. 12(*a*) to 12(*c*). A line b1 in FIG. 15(*c*) represents the brightness of the pixel in the conventional liquid crystal display device like the line b1 shown in FIG. 12(*c*), and a line b2 represents the brightness of the pixel in the liquid crystal display device of the TN mode based on the method (2). As shown in FIGS. 15(*a*) to 15(*c*), the response waveform of the brightness of the liquid crystal display device of the TN mode based on the method (2) is not forming a step; i.e., two-step response is not occurring. In the liquid crystal display device effecting a uniform alignment control processing on the whole surface of the substrate like the TN, IPS and rubbing VA modes, the two-step response is suppressed by the method (2), and a high-speed response is realized.

A line b3 of FIG. 15(*c*) represents the brightness of the liquid crystal display device of the MVA mode relying upon the method (2). The liquid crystal display device of the MVA mode based on the method (2) shortens the response time to some extent but is not capable of improving the two-step response. Thus, the liquid crystal display device of the MVA mode is not capable of accomplishing a high-speed response by simply applying the conventional method (2).

In order to clarify the cause which makes it difficult to increase the response speed in the liquid crystal display device of the MVA mode, the response state of the liquid crystal was observed by using a high-speed camera. FIGS. 16A to 17H are illustrating the states of response of the liquid crystal of when a voltage for displaying white is applied to the liquid crystal of a pixel displaying black in the liquid crystal display panel of the MVA mode. The liquid crystal display panel has an alignment regulating structure extending aslant (about 45°) relative to the ends of the pixel. FIGS. 16A to 17H illustrate a state where the liquid crystal display panel is held by a pair of polarizing plates arranged in cross Nicols, and is irradiated with light from the back. In FIGS. 16A to 16H, the axes of polarization of the two polarizing plates are arranged nearly in parallel with the ends of the pixel like in a general liquid crystal display device of the MVA mode and in FIGS. 17A to 17H, the axes of polarization of the two polarizing plates are arranged nearly in parallel with the direction in which the alignment regulating structure extends so that the disturbance of the liquid crystal can be easily observed. FIGS. 16A and 17A illustrate the states 40 ms after the voltage is applied, FIGS. 16B and 17B illustrate the states after 8 ms, FIGS. 16C and 17C illustrate the states after 12 ms, and FIGS. 16D and 17D illustrate the states after 20 ms. Further, FIGS. 16E and 17E illustrate the states after 32 ms, FIGS. 16F and 17F illustrate the states after 40 ms, FIGS. 16G and 17G illustrate the states after 80 ms and FIGS. 16H and 17H illustrate the states after 300 ms. As shown in FIG. 16A to 17H, the alignment of the liquid crystal is greatly disturbed just after the application of the voltage. It is learned that to obtain a desired brightness after the disturbance of alignment has extinguished, a time of about several tens of milliseconds (equivalent to several frames) is necessary from the application of voltage. In the liquid crystal display device of the MVA mode having the alignment regulating structure as described above, the high-speed response is impaired by the two-step response and by the disturbance of alignment of the liquid crystal making it impossible to obtain favorable response characteristics.

Patent document 1: Japanese Patent No. 2947350

Patent document 2: JP-A-2000-231091

Patent document 3: JP-A-2001-117074

SUMMARY OF THE INVENTION

It is, therefore, an object of the present invention to provide a liquid crystal display device that exhibits favorable response characteristics and a method of driving the same.

The above object is achieved by a liquid crystal display device comprising a pair of substrates arranged facing each other, liquid crystal sealed between the pair of substrates, an alignment regulating structure formed on at least either one of the pair of substrates for regulating the alignment of the liquid crystal, a switching element formed on one of the pair of substrates, a plurality of bus lines connected to the switching element, a bus line drive circuit portion for feeding predetermined drive signals to the plurality of bus lines, and a control circuit portion for so controlling the bus line drive circuit portion that, when a display state of a pixel is to be changed from a dark display to a bright display having a brightness higher than that of the dark display, a difference between magnitude of a first voltage applied to the liquid crystal of the pixel at the beginning of a first frame for changing the display state and magnitude of a second voltage applied to the liquid crystal of the pixel in a second frame or a subsequent frame following the first frame, becomes greater than magnitude of voltage change occurring in the first frame due to a change in the liquid crystal capacitance of the pixel.

According to the present invention, there is realized a liquid crystal display device featuring good response characteristics.

DETAILED DESCRIPTION OF THE INVENTION

Figure 1A:
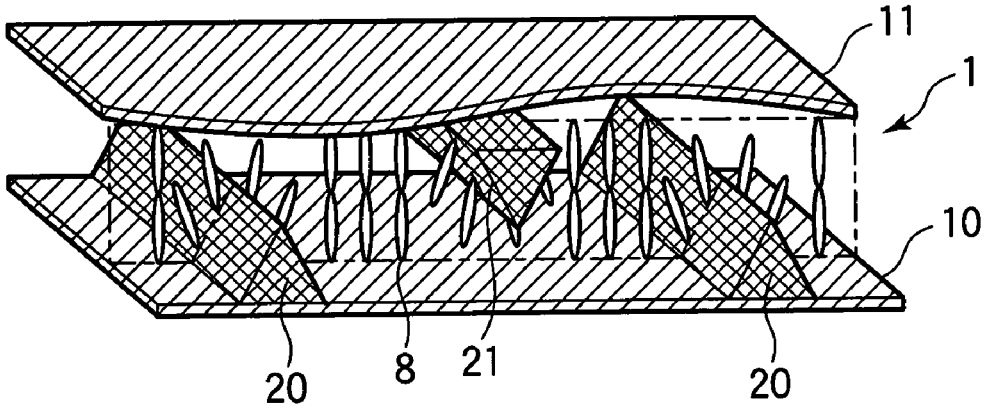
FIGS. 1A and 1B are views illustrating the constitution in cross section of a liquid crystal display device according to an embodiment of the invention.
Figure 1B:
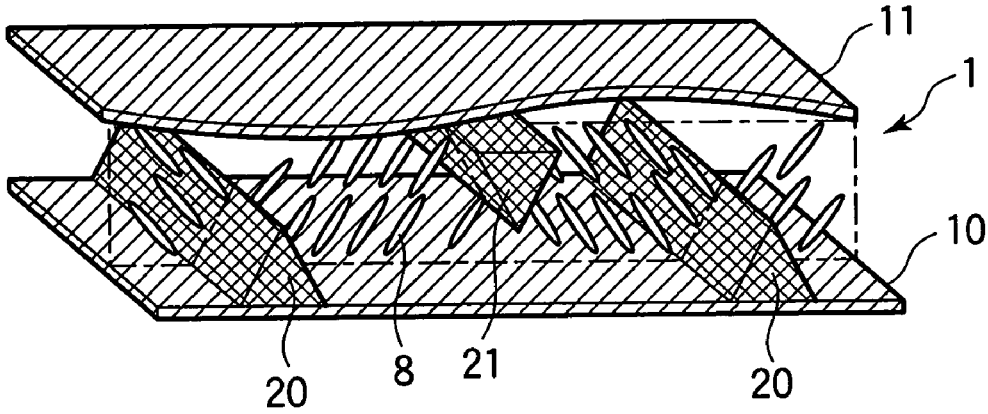
Figure 2:
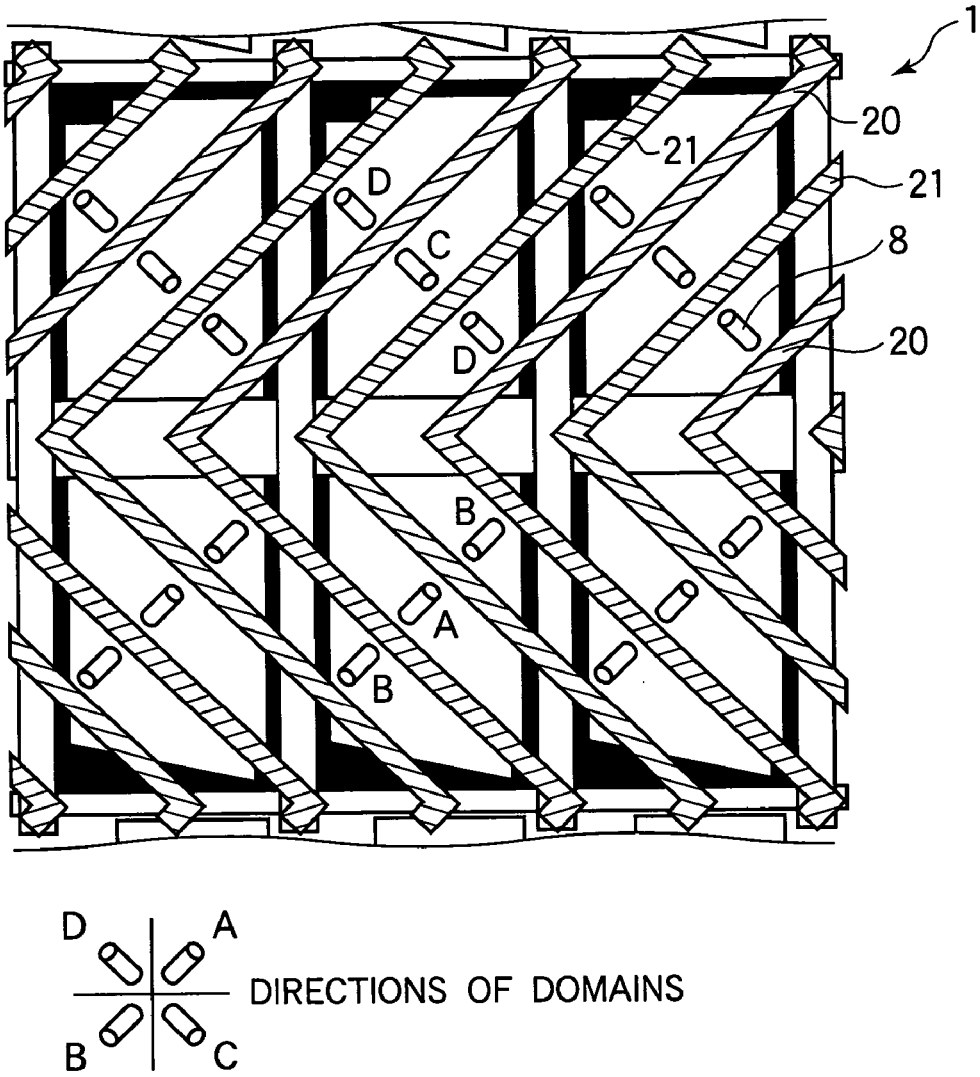
FIG. 2 is a view schematically illustrating the constitution of three pixels in the liquid crystal display device according to the embodiment of the invention and the direction of alignment of the liquid crystal molecules.

A liquid crystal display device and a method of its driving according to an embodiment of the invention will now be described with reference to FIGS. 1A to 10. FIGS. 1A and 1B are views schematically illustrating the sectional constitution of a liquid crystal display panel 1 of the MVA mode possessed by the liquid crystal display device of this embodiment. FIG. 1A illustrates a state where no voltage is applied to the liquid crystal, and FIG. 1B illustrates a state where a voltage is applied to the liquid crystal. FIG. 2 is a view schematically illustrating the constitution of three pixels in the liquid crystal display panel 1 of the MVA mode and the direction of alignment of the liquid crystal molecules. In the liquid crystal display panel 1 of the MVA mode as shown in FIGS. 1A and 1B, the liquid crystal molecules 8 having a negative dielectric anisotropy are arranged between two pieces of glass substrates 10 and 11 nearly perpendicularly to the surface of the substrates. Though not illustrated, on one glass substrate 10, there are formed a TFT and a pixel electrode connected to the TFT for each pixel region, and a common electrode is formed on the whole surface of the other glass substrate 11. A linear protrusion 20 is formed on the pixel electrode on the glass substrate 10 as a structure for regulating the alignment of the liquid crystal, and a linear protrusion 21 is formed on the common electrode on the glass substrate 11. The protrusions 20, 21 are alternately in parallel with each other. A vertical alignment film (not shown) is formed on the pixel electrode, on the common electrode and on the protrusions 20, 21. A pair of polarizing plates are arranged in cross Nicols on both side of the liquid crystal display panel 1.

In a state where no voltage is applied to the liquid crystal as shown in FIG. 1A, the liquid crystal molecules 8 are aligned nearly perpendicularly to the surface of the substrate. Black is displayed in this state. Referring to FIG. 1B, if a predetermined voltage is applied to the liquid crystal, the liquid crystal molecules 8 are tilted to display a predetermined gradation (e.g., white). Here, the direction in which the liquid crystal molecules 8 tilt is regulated by the protrusions 20 and 21, and the liquid crystal molecules 8 are aligned in a plurality of directions. Referring to FIG. 2, the protrusions 20 and 21 are extending aslant relative to the ends of the pixels. Thus, when the protrusions 20 and 21 are formed, the liquid crystal molecules 8 are aligned in four directions A, B, C and D in each pixel. In the liquid crystal display device of this embodiment as described above, the liquid crystal molecules 8 are aligned in a plurality of directions in each pixel when a voltage is applied offering good viewing angle characteristics. In this embodiment, linear protrusions 20 and 21 are formed on two pieces of glass substrates 10 and 11. Instead of protrusions 20, however, there may be formed slits in the pixel electrodes.

Figure 3:
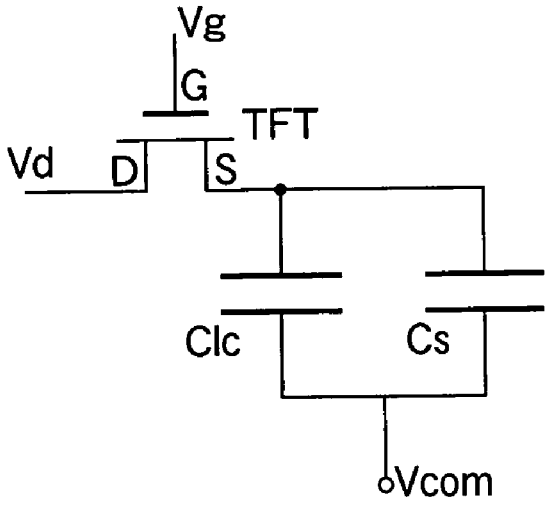
FIG. 3 is a diagram illustrating an equivalent circuit of a pixel in the liquid crystal display device according to the embodiment of the invention.
Figure 11:
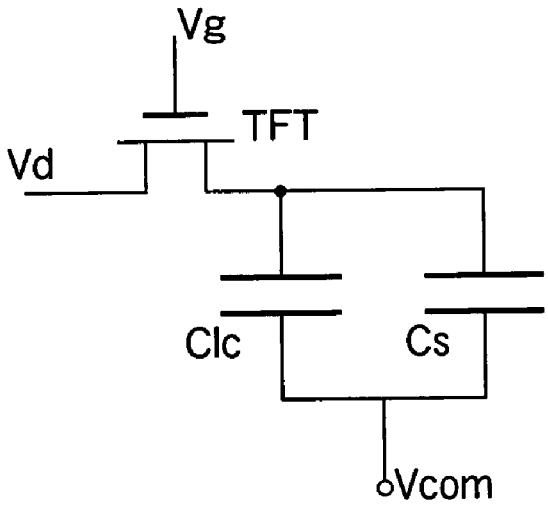
FIG. 11 is a diagram illustrating an equivalent circuit of a pixel in a conventional liquid crystal display device.

FIG. 3 illustrates an equivalent circuit of a pixel in the liquid crystal display device according to the embodiment. As shown in FIG. 3, each pixel is provided with a TFT as a switching element. The gate electrode G of the TFT is electrically connected to the gate bus line, and a predetermined gate voltage Vg is applied to the gate electrode G. The drain electrode D of the TFT is electrically connected to a drain bus line and is applied with a predetermined data voltage Vd. The source electrode S of the TFT is electrically connected to a pixel electrode on one side of a liquid crystal capacitance Clc and to a storage capacitor electrode on one side of a storage capacitor Cs. A common electrode which is the other electrode of the liquid crystal capacitance Clc and a storage capacitor bus line which is the other electrode of the storage capacitor Cs are maintained at a common voltage Vcom.

Figure 4:
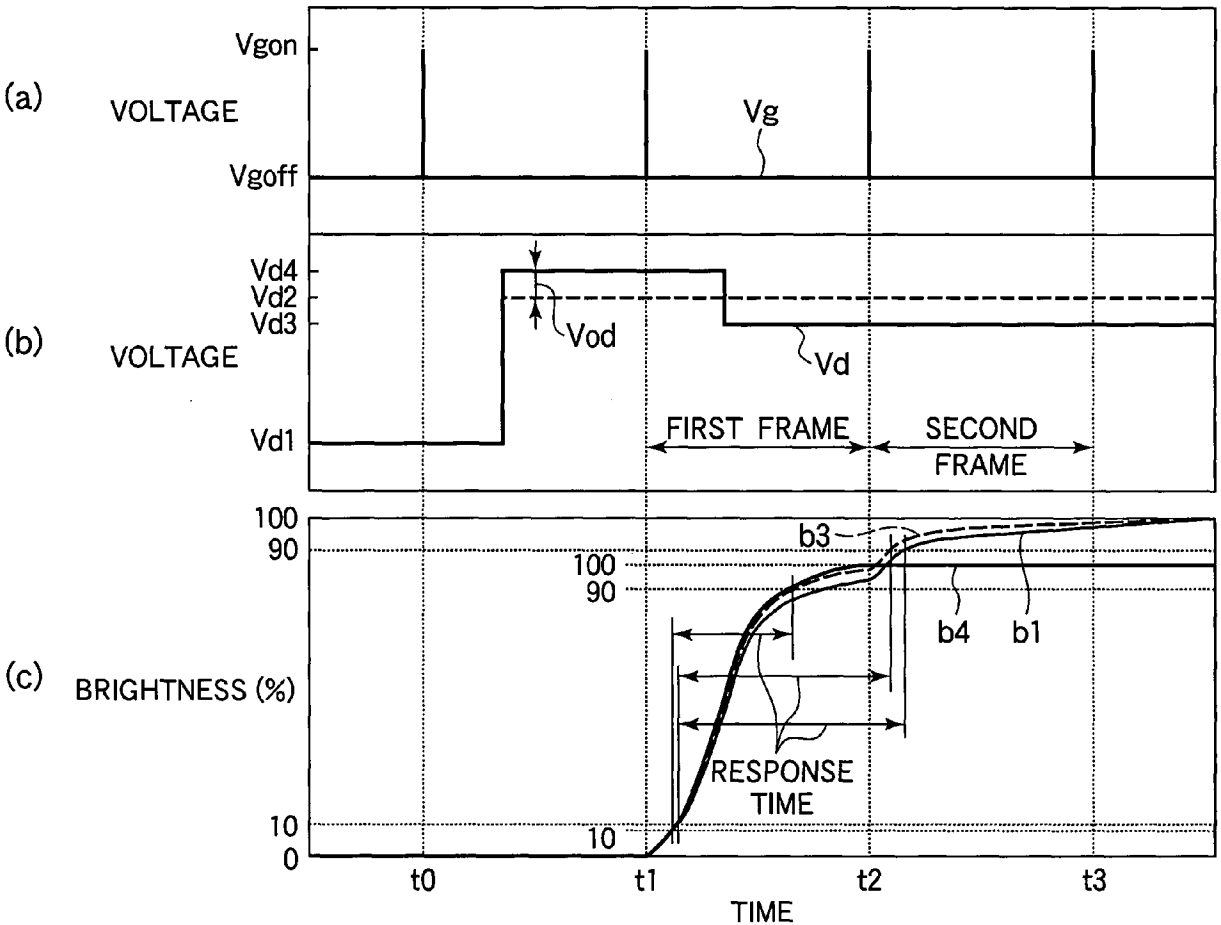
FIG. 4 is a diagram illustrating response characteristics of the liquid crystal display device according to the embodiment of the invention.
Figure 12:
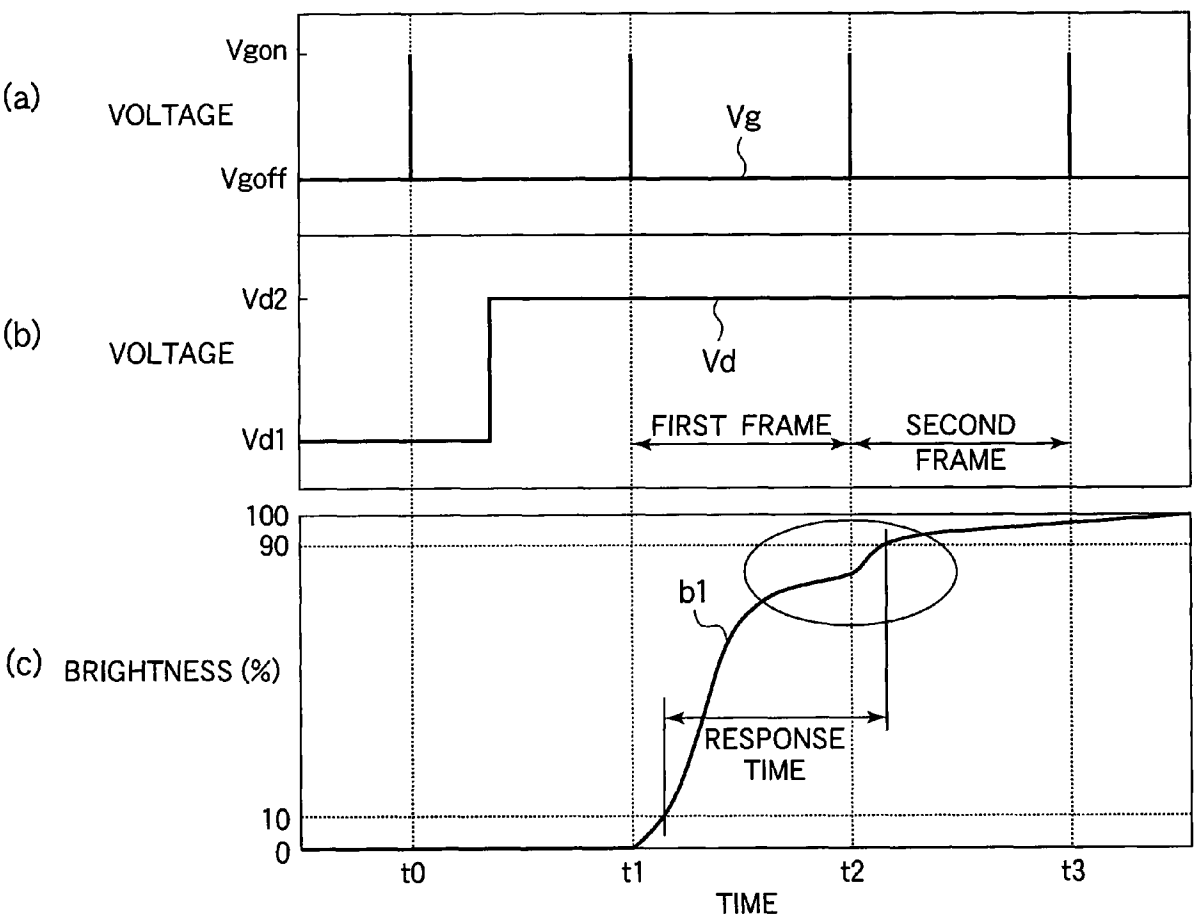
FIG. 12 is a diagram illustrating the response characteristics of the conventional liquid crystal display device.
Figure 13:
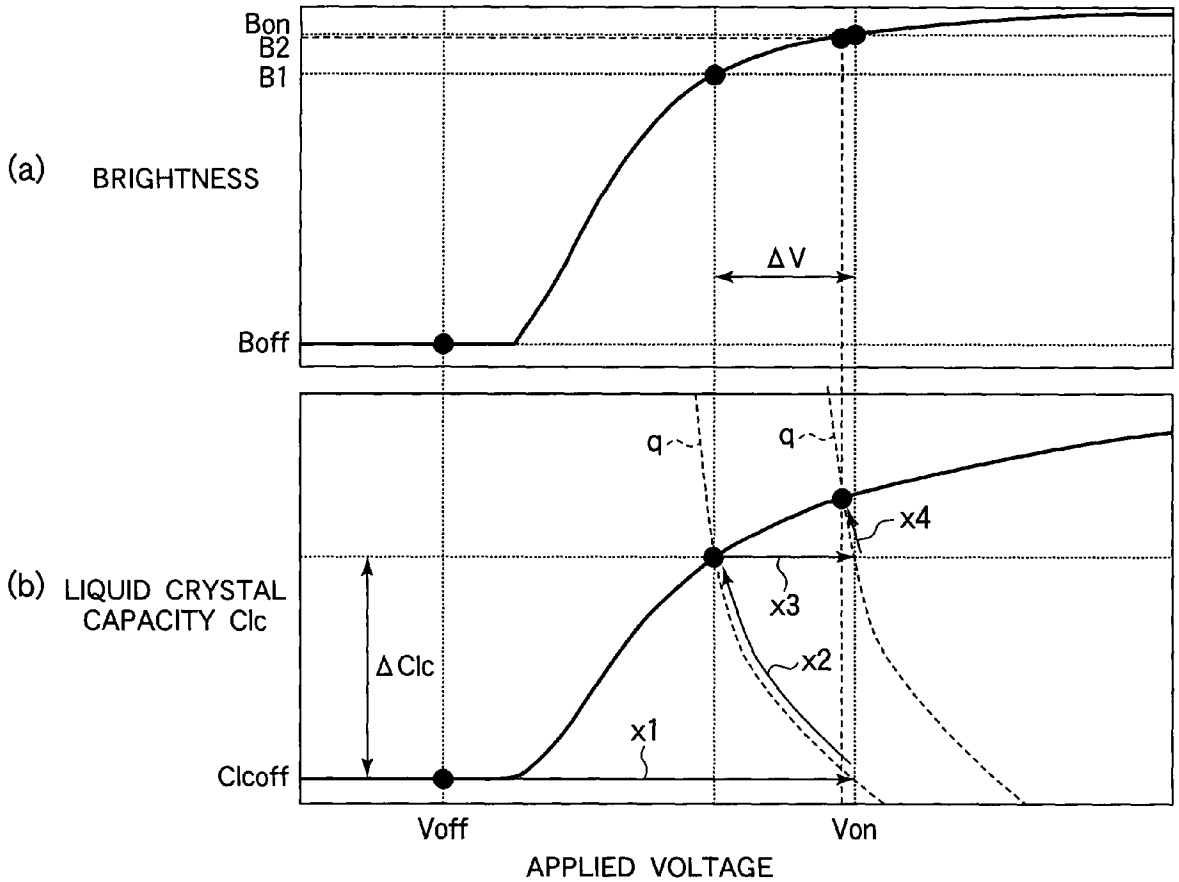
FIG. 13 is a diagram illustrating a cause of a two-step response.
Figure 14:
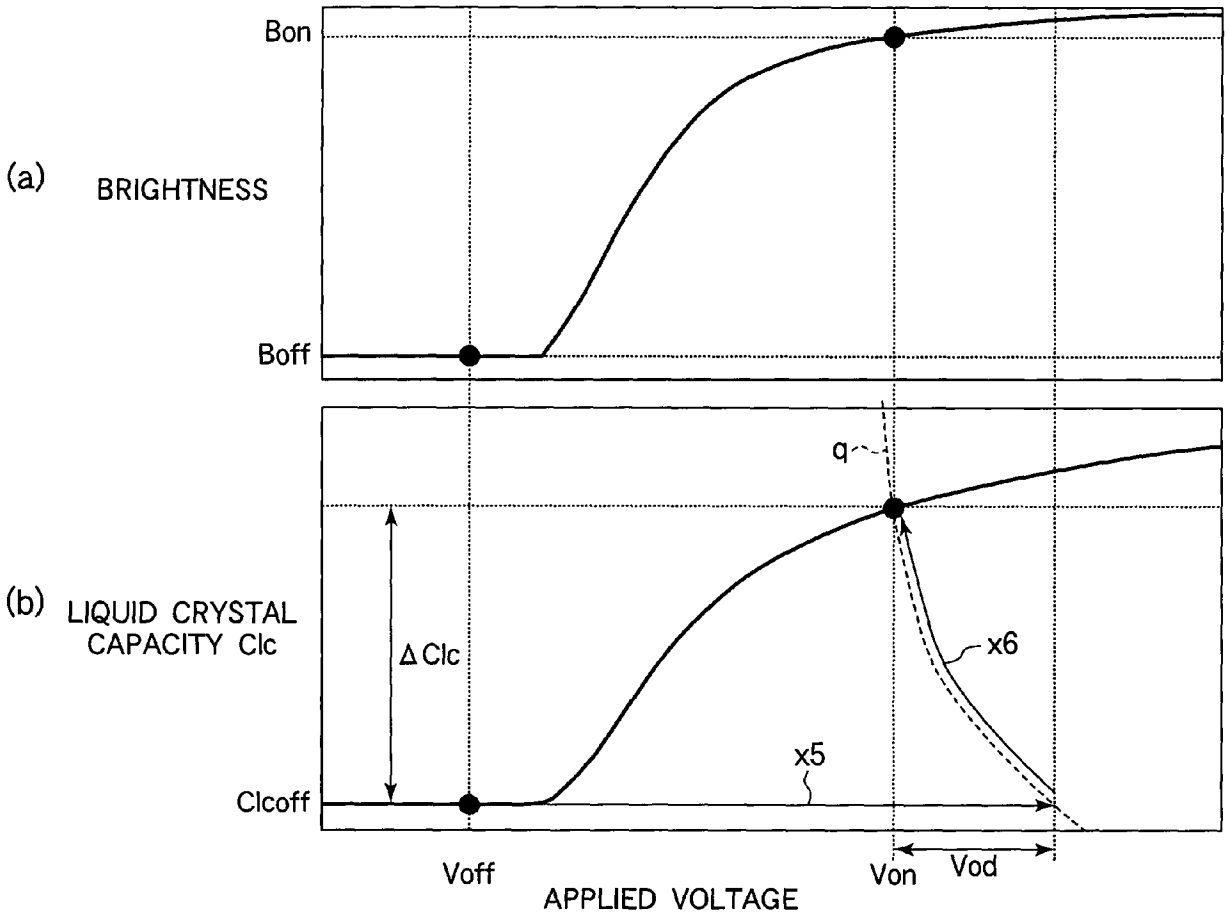
FIG. 14 is a diagram illustrating a liquid crystal display device of an over-drive type.
Figure 15:
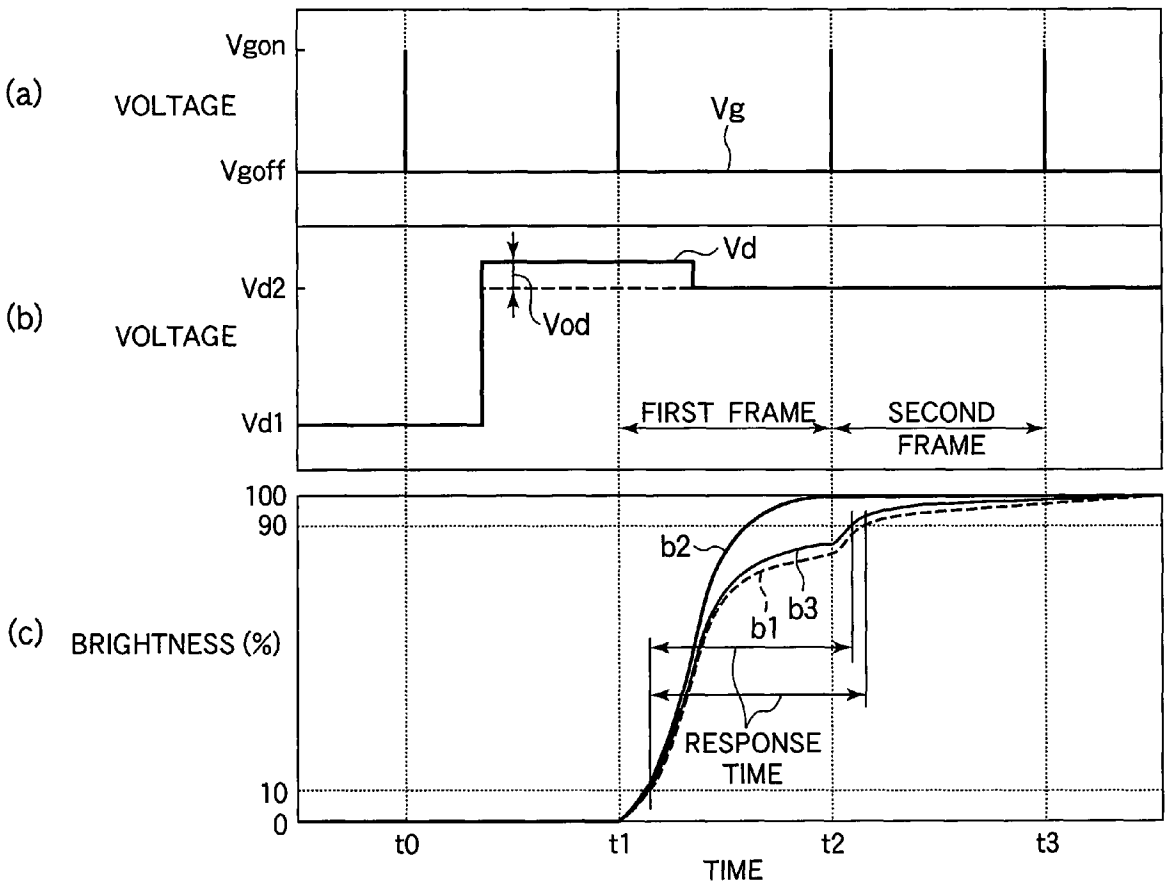
FIG. 15 is a diagram illustrating the response characteristics of a conventional liquid crystal display device of the over-drive type.
Figures 16A, 16B, 16C, 16D, 16E, 16F, 16G, 16H:
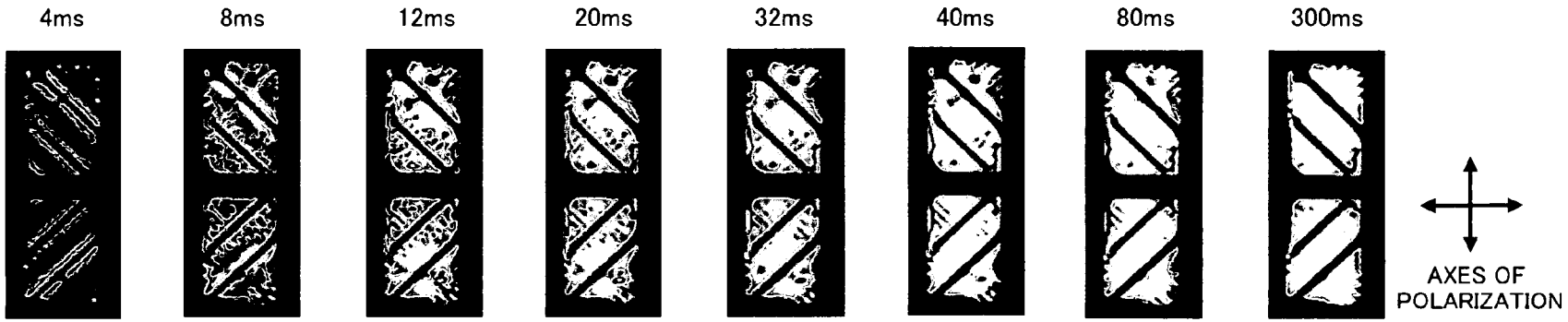
FIGS. 16A to 16H are diagrams illustrating the response states of liquid crystal in a conventional liquid crystal display device of the MVA mode.
Figures 17A, 17B, 17C, 17D, 17E, 17F, 17G, 17H:
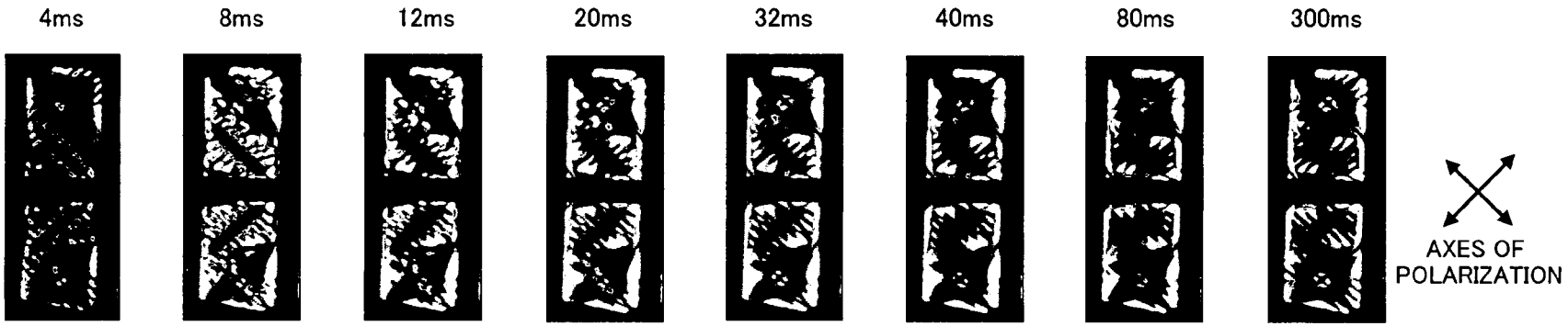
FIGS. 17A to 17H are diagrams illustrating the response states of liquid crystal in the conventional liquid crystal display device of the MVA mode.

FIG. 4(*a*) is a graph illustrating a gate voltage Vg applied to the gate bus line connected to the gate electrode G of the TFT of a given pixel, FIG. 4(*b*) is a graph illustrating a data voltage Vd (absolute value) applied to the drain bus line connected to the drain electrode D of the TFT of the above pixel, and FIG. 4(*c*) is a graph illustrating the brightness of the pixel. The abscissas of FIGS. 4(*a*) to 4(*c*) represent the time, the ordinates of FIGS. 4(*a*) and 4(*b*) represent the voltage level, and the ordinate of FIG. 4(*c*) represents the brightness (%). A line b4 in FIG. 4(*c*) represents the brightness of the pixel in the liquid crystal display device according to this embodiment, a line b1 represents the brightness of the pixel in the conventional liquid crystal display device like the line b1 shown in FIG. 12(*c*), and a line b3 represents the brightness of the pixel in the liquid crystal display device of the MVA mode of the conventional over-drive type like the line b3 shown in FIG. 15(*c*). In this embodiment, the pixels connected to the same drain bus line as that of the above pixel are all changed from the black display to the white display, and the display data are input to the liquid crystal display device from the external unit such that the white display is maintained for several frames. The frame period is 16.7 ms.

Referring to FIG. 4(*a*), the gate electrode G of the TFT of the pixel is applied with a voltage Vgon (gate pulse) at times t0, t1, t2 , , , of every frame period, and the TFT is periodically turned on. When the TFT is turned on, the data voltage Vd is applied to the pixel electrode of the pixel, and the electric charge is stored in the liquid crystal capacitance Clc and in the storage capacitor Cs. The stored electric charge is held for one frame period until the TFT is turned on next. Referring to FIG. 4(*b*), the data voltage Vd applied to the drain bus line is changing between a time t0 and a time t1 from a voltage Vd1 displaying black to a voltage Vd4 (|Vd4|>|Vd1|). To the pixel electrode of the pixel is applied, at the time t1, the voltage Vd4 higher than the voltage Vd1 of the preceding frame. The frame period that starts from the time tl is referred to as the first frame.

Like that of the general over-drive system, the voltage Vd4 applied to the first frame is higher than the voltage Vd2 applied for displaying white by a voltage Vod (>0) that decreases accompanying an increase in the liquid crystal capacitance Clc in the first frame (|Vd4−Vd2|=Vod). Therefore, the voltage Vd4 (first voltage) is applied to the liquid crystal at the beginning of the first frame. At the end of the first frame, the voltage Vd2 (third voltage) is applied to the liquid crystal.

In the second and subsequent frames, a voltage Vd3 (second voltage) lower than the voltage Vd2 is applied (|Vd3|<|Vd2|) unlike that of the general over-drive system. That is, the difference between the voltage Vd4 and the voltage Vd3 is greater than the voltage Vod that decreases accompanying an increase in the liquid crystal capacitance Clc in the first frame (|Vd4−Vd3|>Vod). The voltage Vd3 is necessary for nearly maintaining the brightness that is obtained at the end of the first frame. In the liquid crystal display device of the MVA mode, the time of about several tens of milliseconds is necessary after the application of voltage in order to the disturbance in the alignment of liquid crystal is extinguished. Therefore, if the voltage Vd2 is applied after the second frame like in the general over-drive system, the brightness of the pixel increases over several frames after the second frame giving rise to the occurrence of a two-step response. In this embodiment, a voltage Vd3 lower than the voltage Vd2 is applied after the second frame by estimating the extinction of disturbance of alignment of the liquid crystal. As represented by a line b4 in FIG. 4(*c*), therefore, the brightness obtained at the end of the first frame is maintained after the second frame so that the two-step response will not occur. In this embodiment, further, the brightness changes in the first frame only but does not change in the second and subsequent frames. Since the brightness obtained at the end of the first frame is a maximum brightness (100%), a response time required from 10% of brightness up to 90% of brightness is shortened. Therefore, there is realized the liquid crystal display device of the MVA mode having a response characteristics capable of sufficiently coping with the display of dynamic images.

The liquid crystal display device and its driving method of the invention will now be concretely described below by way of embodiments.

Embodiment 1

Figure 5:
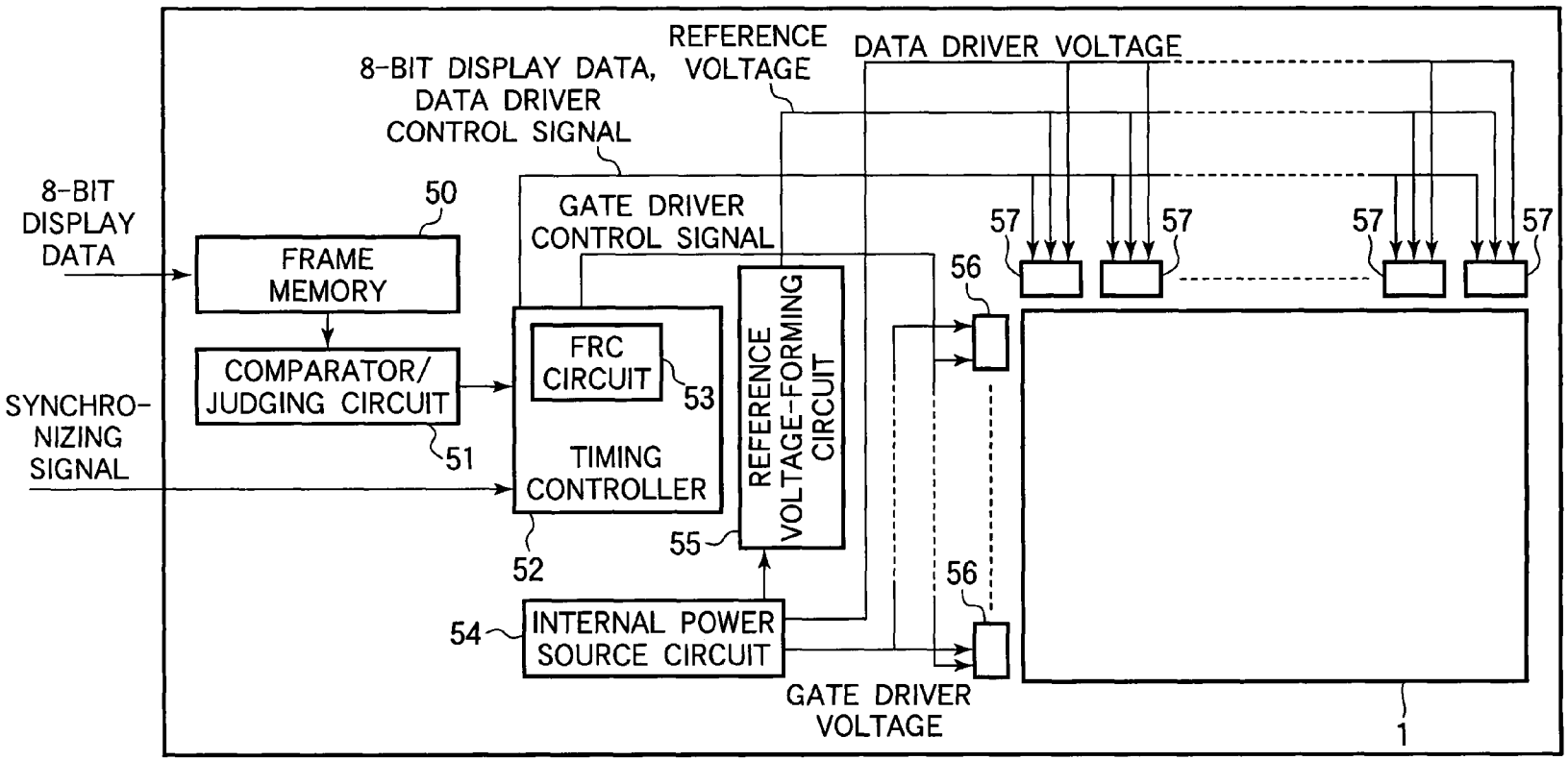
FIG. 5 is a diagram schematically illustrating the constitution of the liquid crystal display device according to a first embodiment of the invention.

The liquid crystal display device and its driving method according an embodiment 1 of the invention will now be described. FIG. 5 is a diagram schematically illustrating the constitution of the liquid crystal display device according to this embodiment. Referring to FIG. 5, the liquid crystal display device includes, as a control circuit portion, a frame memory 50 for storing, for example, two frames of 8-bit display data input from an external unit, a comparator/judging circuit 51 for comparing two frames of display data stored in the frame memory 50 for each pixel to judge a change in the gradation for each pixel and for producing a gradation change data including data of a pixel of which the gradation has changed from the dark display to the bright display, and a timing controller 52 which receives display data and gradation change data from the comparator/judging circuit 51 and receives synchronizing signals from an external unit. The timing controller 52 includes an FRC circuit 53 which realizes a frame rate control (FRC) technology that will be described later. The liquid crystal display device includes an internal power source circuit 54 and a reference voltage-forming circuit 55 which is served with power from the internal power source circuit 54 and forms reference voltages of a plurality of levels by using, for example, an operational amplifier. The liquid crystal display device further includes a liquid crystal display panel 1 of the MVA mode, a gate bus line drive circuit (gate driver) 56 for producing a predetermined drive signal to a plurality of gate bus lines of the liquid crystal display panel 1, and a drain bus line drive circuit (data driver) 57 for producing a predetermined drive signal to a plurality of drain bus lines of the liquid crystal display panel 1. The gate driver 56 receives a gate driver control signal from the timing controller 52 and receives a gate driver voltage from the internal power source circuit 54. The data driver 57 receives 8-bit display data and data driver control signal from the timing controller 52, receives reference voltages of a plurality of levels from the reference voltage-forming circuit 55, and receives the data driver voltage from the internal power source circuit 54.

Figure 6:
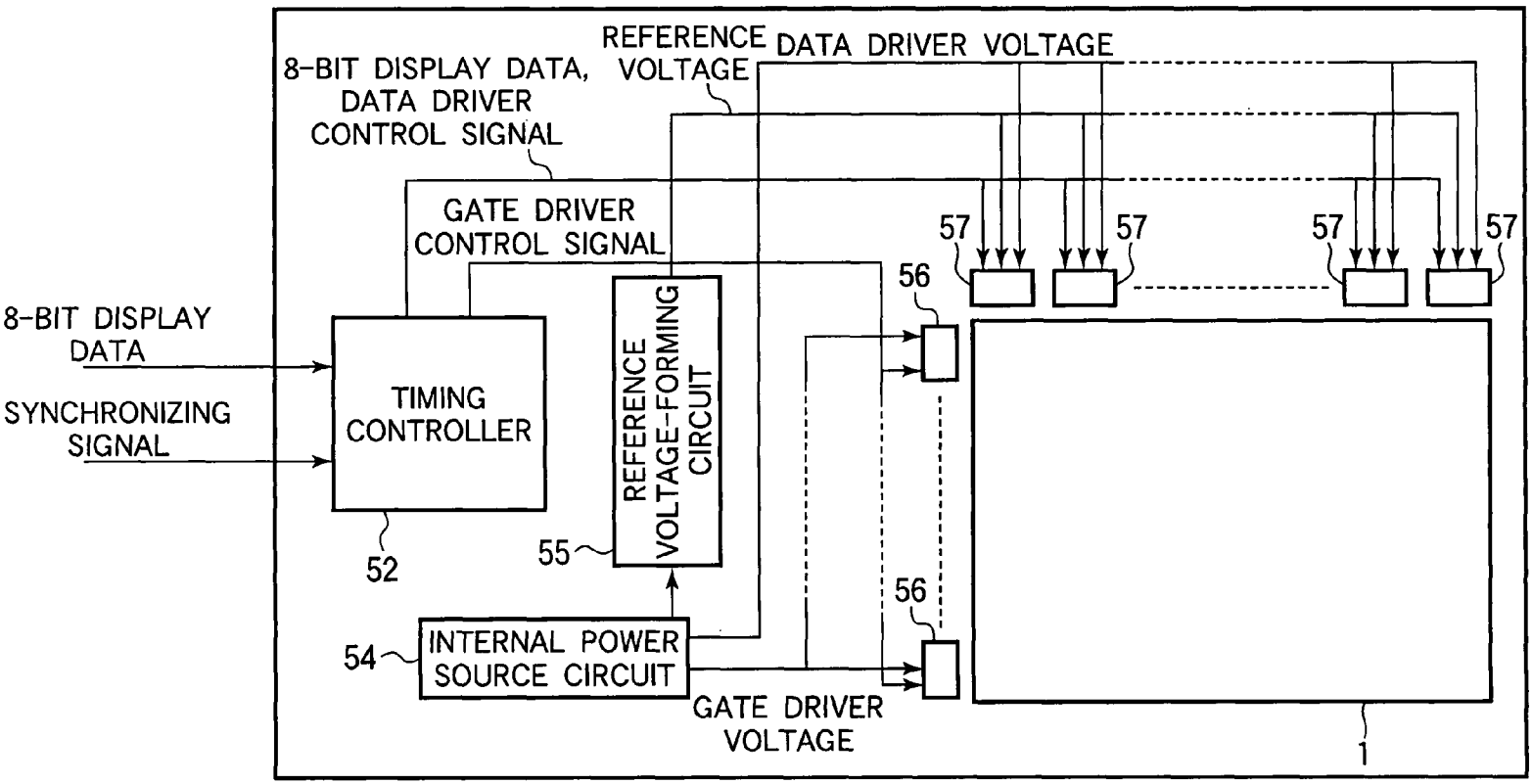
FIG. 6 is a diagram schematically illustrating the constitution of a conventional liquid crystal display device.

FIG. 6 schematically illustrates the constitution of a conventional liquid crystal display device. When compared to the conventional liquid crystal display device shown in FIG. 6, the liquid crystal display device of the embodiment shown in FIG. 5 has a feature concerning the provision of the frame memory 50, comparator/judging circuit 51 and FRC circuit 53. Like the conventional liquid crystal display device, further, the liquid crystal display device of this embodiment has a data driver 57 that corresponds to general 256 gradations. By using reference voltages of a plurality of levels input from the reference voltage-forming circuit 55, the data driver 57 corresponding to 256 gradations selectively produces voltages of 256 levels corresponding to 8-bit display data (0 to 255) which are divided by resistors in the driver. Therefore, a voltage corresponding to 255 gradations (11111111) of 8-bit display data is a maximum voltage that can be applied to the liquid crystal, and a voltage equal to greater than the above voltage is not usually applied to the liquid crystal.

In this embodiment, when the gradation of a given pixel has changed from 0 gradation (dark display) to 255 gradations (bright display), the brightness of this pixel obtained at the end of the first frame is found in advance, and the gradation of the second and subsequent frames is set with the above brightness as 100%. For example, when the brightness reached at the end of the first frame corresponds to 243 gradations in the display data input to the data driver 57, the control circuit portion forms the gradations of 256 levels relying upon 0 to 243 gradations by using the FRC technology. The FRC technology is for displaying an intermediate gradation which is essentially difficult to be displayed by using a plurality of frames of a combination of gradations of a plurality of levels. For example, 1021 gradations can be displayed by generating gradations of 3 levels in between neighbor gradations of each of 0 to 255 gradations. From them, 256 gradations are arbitrarily taken out to obtain gradated brightness characteristics different from the gradated brightness characteristics that have heretofore been set to the liquid crystal display device. The FRC technology is for converting the data, and the FRC circuit 53 can be easily incorporated in the LSI of the timing controller 52.

Figure 7A:
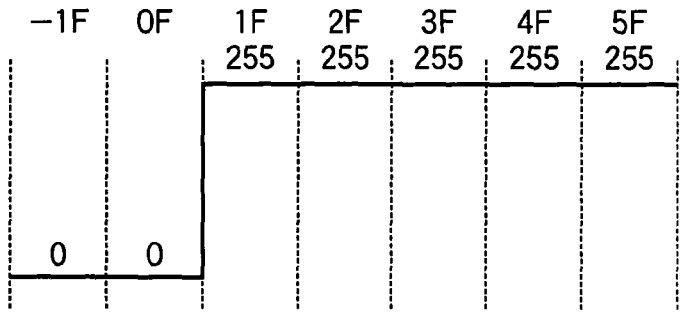
FIGS. 7A and 7B are diagrams illustrating a method of driving the liquid crystal display device according to the first embodiment of the invention.
Figure 7B:
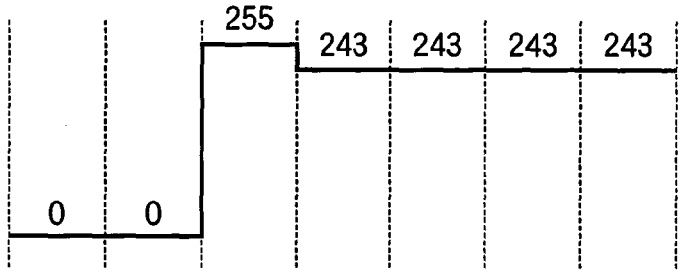

FIG. 7A illustrates a example of display data input to the liquid crystal display device, and FIG. 7B illustrates a example of display data output to the data driver 57 from the control circuit portion when the above display data are input thereto. The display data of FIG. 7A show that the pixels connected to a given drain bus line are all changed from the black display (0 gradation) to the white display (255 gradations) in the first frame (1F). Based on the gradation change data formed by the comparator/judging circuit 51, the control circuit portion produces, to the data driver 57, the display data of 255 gradations in the first frame only as shown in FIG. 7B. When the display data of 255 gradations are continuously input to the liquid crystal display device in the second frame (2F) and in the subsequent frames, too, the control circuit portion produces, to the data driver 57, the display data of, for example, 243 gradations in the second and subsequent frames. By having 243 gradations of output data to the data driver 57 corresponded to the white display, the gradation level of output data to the data driver 57 decreases by 12 (=255−243) gradations. In this embodiment as described above, the display of 256 gradations is obtained by forming gradations of 256 levels among 0 to 243 gradations by using the FRC technology.

Figure 8A:
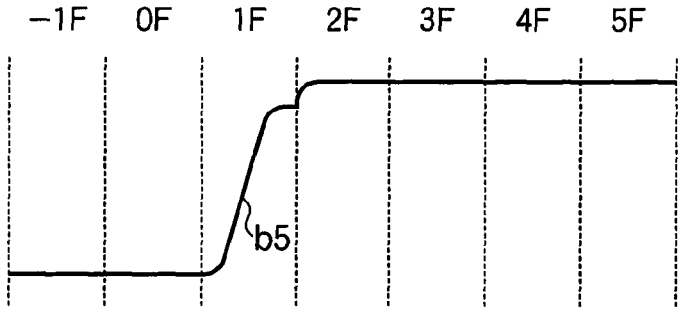
FIGS. 8A and 8B are diagrams illustrating the effects of the liquid crystal display device according to the first embodiment of the invention.
Figure 8B:
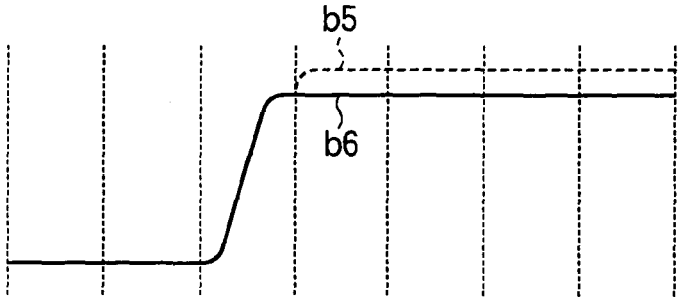

FIG. 8A illustrates a change in the brightness of a pixel in the conventional liquid crystal display device of the MVA mode, and FIG. 8B illustrates a change in the brightness of a pixel in the liquid crystal display device of the MVA mode according to this embodiment. In FIGS. 8A and 8B, the abscissas represent the time and the ordinate represents the brightness level. According to the conventional liquid crystal display device of the MVA mode as represented by a line b5 in FIG. 8A, a two-step response is occurring when the dark display changes into the bright display. In the liquid crystal display device of the MVA mode of this embodiment, on the other hand, the two-step response is suppressed as represented by a line b6 in FIG. 8B. Therefore, this embodiment realizes the liquid crystal display device of the MVA mode having response characteristics that can cope with the dynamic display to a sufficient degree.

Embodiment 2

Figure 9:
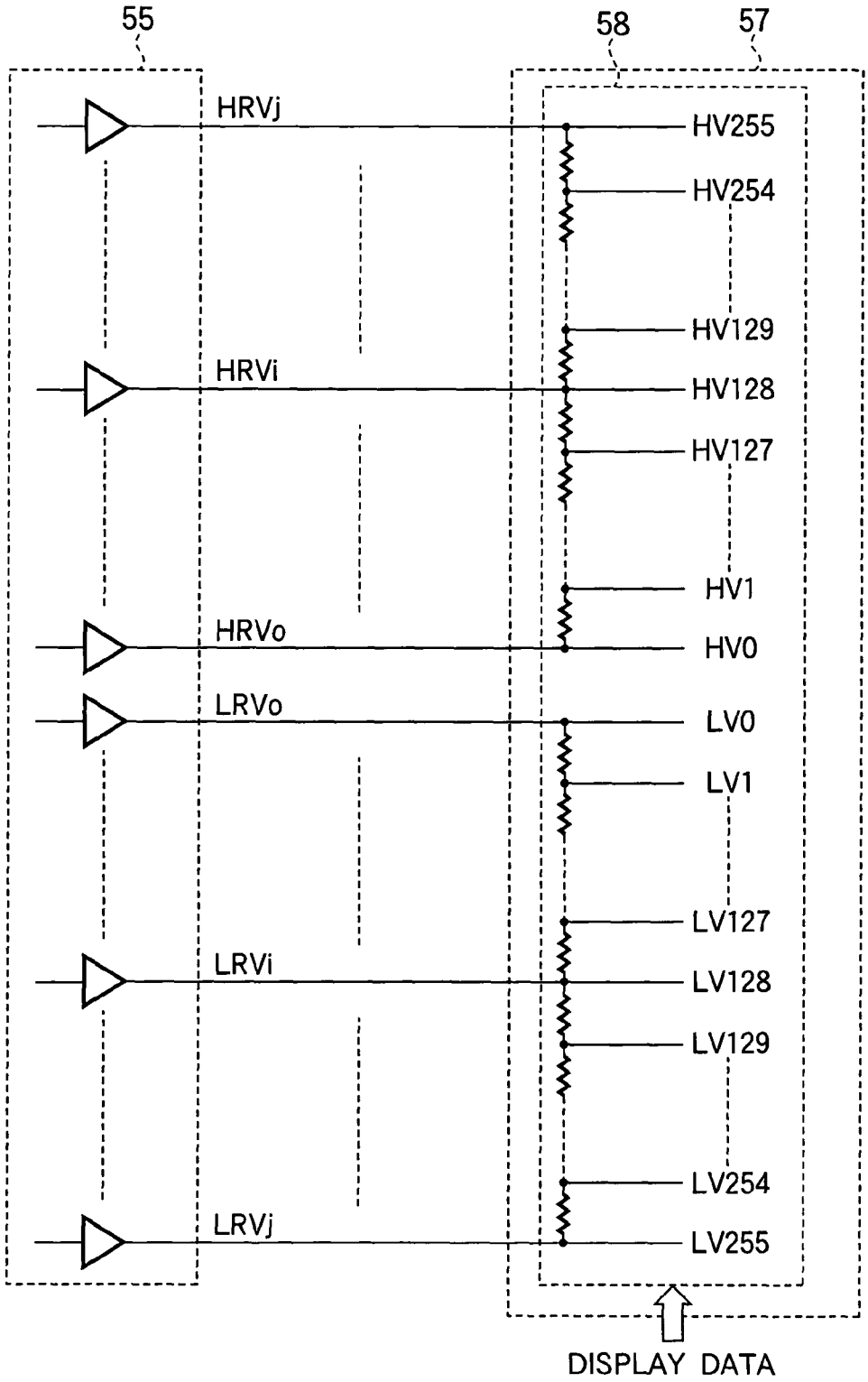
FIG. 9 is a diagram schematically illustrating the constitution of a D/A converter portion in the data driver and of a reference voltage-forming circuit in a conventional liquid crystal display device that served as a prerequisite for a second embodiment of the invention.

The liquid crystal display device and its driving method according an embodiment 2 of the invention will now be described. This embodiment does not rely upon the FRC technology but uses a dedicated data driver. FIG. 9 illustrates a D/A converter portion in the conventional data driver and a reference voltage-forming circuit, that serve as a prerequisite of this embodiment. Referring to FIG. 9, the reference voltage-forming circuit 55 produces reference voltages HRVn (n=0 , , , i , , , j) of (j+1) levels of a positive polarity and reference voltages LRVn (n=0 , , , i , , , j) of (j+1) levels of a negative polarity. By using the reference voltages HRVn and LRVn, the D/A converter portion 58 in the data driver 57 produces voltages HV0 to HV255 of 256 levels of the positive polarity and voltages LV0 to LV255 of 256 levels of the negative polarity by the division by resistors. In the conventional data driver 57, the voltages corresponding to 255 gradations which are maximum values in the 8-bit display data that are input, are HV255 and LV255. The voltages HV255 and LV255 are maximum voltages applied to the liquid crystal in the pixel driven by the data driver 57. The magnitudes of the voltages are limited by reference voltages fed from the reference voltage-forming circuit 55.

Figure 10:
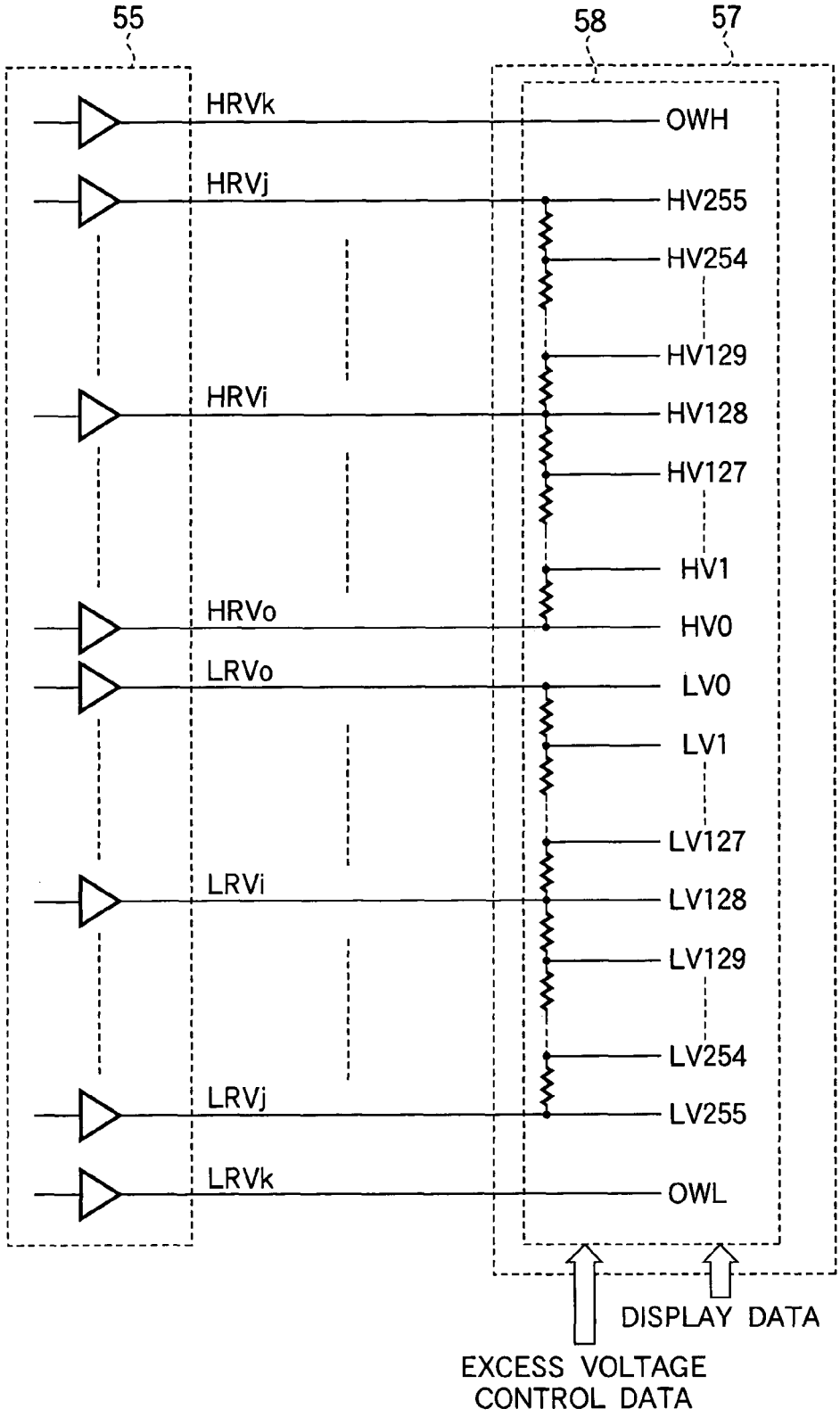
FIG. 10 is a diagram schematically illustrating the constitution of a D/A converter portion in the data driver and of a reference voltage-forming circuit in the liquid crystal display device according to the second embodiment of the invention.

FIG. 10 illustrates a D/A converter portion in the data driver and a reference voltage-forming circuit in the liquid crystal display device according to this embodiment. Referring to FIG. 10, the reference voltage-forming circuit 55 produces reference voltages HRVn (n=0 , , , i , , , j) of a positive polarity and reference voltages LRVn (n=0 , , , i , , , j) of a negative polarity, as well as reference voltages HRVK (positive polarity) and LRVk (negative polarity) for excessive voltages. The D/A converter portion 58 in the data driver 57 produces excessive voltages OWH (positive polarity) and OWL (negative polarity) corresponding to the reference voltages HRVk and LRVk. OWH and OWL are voltages having absolute values greater than those of HV255 and LV255.

In this embodiment, the reference voltages are so set that the voltages corresponding to 243 gradation in the second and subsequent frames in the embodiment 1 become HV255 and LV255. In this embodiment, further, excessive voltage control data are added to the 8-bit display data output to the data driver 57 from the control circuit portion. The excessive voltage control data includes control data related to whether an excessive voltage OWH or OWL be output to the data driver 57, or whether an ordinary voltage of a maximum of HV255 or LV255 be output according to 8-bit display data. Excessive voltages of a plurality of levels can be selected between OWH and HV255, and between OWL and LV255 by forming excessive voltages of a plurality of levels by the division by resistors and by forming excessive voltage control data of a plurality of bits. This embodiment realizes the liquid crystal display device of the MVA mode having response characteristics that can cope with the dynamic display to a sufficient degree like that of the embodiment 1.

The invention can be modified in a variety of ways not being limited to the above embodiments only.

The above embodiments have dealt with the case where the display of pixel changes from black into white. Not being limited thereto only, however, the invention can be applied to changing black into an intermediate tone or changing the intermediate tone into white provided the dark display changes into the bright display in a relative sense.

What is claimed is:

1. A liquid crystal display device of a multi-domain vertical alignment mode comprising:

a pair of substrates arranged facing each other;

liquid crystal sealed between the pair of substrates;

an alignment regulating structure formed on at least one of the pair of substrates for regulating the alignment of the liquid crystal;

a switching element formed on one of the pair of substrates;

a plurality of bus lines connected to the switching element;

a bus line drive circuit portion for feeding predetermined drive signals to the plurality of bus lines; and a control circuit portion for so controlling the bus line drive circuit portion such that, when a display state of a pixel is to be changed from a dark display to a bright display having a brightness higher than that of the dark display, a difference between a magnitude of a first voltage applied to the liquid crystal of the pixel at the beginning of a first frame for changing the display state and a magnitude of a second voltage applied to the liquid crystal of the pixel in a second frame or a subsequent frame following the first frame becomes greater than a magnitude of voltage change occurring in the first frame due to a change in the liquid crystal capacitance of the pixel, wherein the magnitude of the second voltage is smaller than the magnitude of a third voltage applied to the liquid crystal in the pixel at the end of the first frame, and further wherein the magnitude of the third voltage is smaller than the magnitude of the first voltage.

2. A liquid crystal display device according to claim 1, wherein the magnitude of the first voltage is greater than the magnitude of the second voltage.

3. A liquid crystal display device according to claim 1, wherein the second voltage is the one which nearly maintains the brightness of the pixel at the end of the first frame.

4. A liquid crystal display device according to claim 1, wherein the dark display is a display of black and the bright display is a display of white.

5. A liquid crystal display device according to claim 1, wherein the control circuit portion includes a frame memory for storing a plurality of frames of display data input from an external unit, and a comparator/judging circuit for comparing the plurality of frames of display data and for judging a change in the display state of the pixels.

6. A liquid crystal display device according to claim 1, wherein the liquid crystal have a negative dielectric anisotropy and are aligned nearly perpendicularly to a surface of the substrate when no voltage is applied.

7. A liquid crystal display device according to claim 1, wherein the alignment regulating structure is a protrusion or a slit in an electrode.

8. A method of driving a liquid crystal display device of a multi-domain vertical alignment mode having a structure for regulating an alignment of liquid crystal, wherein when a display state of a pixel is to be changed from a dark display to a bright display having a brightness higher than that of the dark display, a difference between a magnitude of a first voltage applied to the liquid crystal of the pixel at the beginning of a first frame for changing the display state and a magnitude of a second voltage applied to the liquid crystal of the pixel in a second frame or a subsequent frame following the first frame is set to be greater than a magnitude of voltage change occurring in the first frame due to a change in the liquid crystal capacitance of the pixel, and wherein the magnitude of the second voltage is smaller than the magnitude of a third voltage applied to the liquid crystal in the pixel at the end of the first frame, and further wherein the magnitude of the third voltage is smaller than the magnitude of the first voltage.

9. A method of driving a liquid crystal display device according to claim 8, wherein the magnitude of the first voltage is greater than the magnitude of the second voltage.

10. A method of driving a liquid crystal display device according to claim 8, wherein the second voltage is a voltage which nearly maintains the brightness of the pixel at the end of the first frame.

11. A method of driving a liquid crystal display device according to claim 8, wherein the dark display is a display of black and the bright display is a display of white.

12. A liquid crystal display device according to claim 1, wherein a difference between the magnitude of the first voltage and the magnitude of the third voltage is equal to the magnitude of voltage change.

13. A method of driving a liquid crystal display device according to claim 8, wherein a difference between the magnitude of the first voltage and the magnitude of the third voltage is equal to the magnitude of voltage change.

* * * * *